US009149160B2

(12) United States Patent
Liu

(10) Patent No.: US 9,149,160 B2
(45) Date of Patent: Oct. 6, 2015

(54) BATH CHAIR

(75) Inventor: Julian Liu, Port Moody (CA)

(73) Assignee: EVOLUTION TECHNOLOGIES INC., Port Coquitlam (CA)

( * ) Notice: Subject to any disclaimer, the term of this patent is extended or adjusted under 35 U.S.C. 154(b) by 1219 days.

(21) Appl. No.: 13/050,681

(22) Filed: Mar. 17, 2011

(65) Prior Publication Data

US 2012/0233767 A1 Sep. 20, 2012

(51) Int. Cl.

| | |
|---|---|
| ***A47K 3/022*** | (2006.01) |
| ***A47K 3/12*** | (2006.01) |
| ***A47C 7/02*** | (2006.01) |

(52) U.S. Cl.

CPC . *A47K 3/125* (2013.01); *A47C 7/02* (2013.01); *A47K 3/122* (2013.01)

(58) Field of Classification Search

USPC ..... 4/573.1, 590, 560, 571.1; 297/452.46, 297/425.42

See application file for complete search history.

(56) References Cited

U.S. PATENT DOCUMENTS

| | | | | |
|---|---|---|---|---|
| 1,406,779 | A | | 2/1922 | Thibadore |
| 3,377,630 | A | | 4/1968 | Robare |
| 3,416,529 | A | | 12/1968 | Weisman |
| 3,584,320 | A | | 6/1971 | Locke |
| D247,593 | S | | 3/1978 | Steele |
| 4,150,445 | A | | 4/1979 | Bailey |
| D274,201 | S | | 6/1984 | Aaron |
| 4,521,926 | A | | 6/1985 | Kuether |
| 4,574,409 | A | | 3/1986 | McAffrey |
| 4,656,678 | A | | 4/1987 | Lipski |
| D294,664 | S | | 3/1988 | Clark |
| D296,047 | S | | 6/1988 | Kucera et al. |
| 4,824,174 | A | * | 4/1989 | Dunn, Sr. ..... 297/452.46 |
| 5,335,377 | A | * | 8/1994 | Masyada et al. ..... 4/578.1 |
| 5,335,970 | A | | 8/1994 | Bryant et al. |
| D355,985 | S | | 3/1995 | Karten et al. |
| D357,361 | S | | 4/1995 | Karten et al. |
| D401,089 | S | | 11/1998 | Ambasz |
| 5,903,935 | A | | 5/1999 | Huelke |
| 5,963,993 | A | | 10/1999 | Dunn |
| D439,429 | S | | 3/2001 | Higgs et al. |
| 6,226,810 | B1 | | 5/2001 | Weddendorf et al. |
| D494,767 | S | | 8/2004 | Self et al. |
| D510,487 | S | | 10/2005 | Self et al. |
| 6,957,865 | B1 | * | 10/2005 | Adams et al. ..... 297/344.12 |

(Continued)

FOREIGN PATENT DOCUMENTS

| | | |
|---|---|---|
| CA | 2196491 | 4/1998 |
| DE | 29721043 | 6/1998 |

(Continued)

OTHER PUBLICATIONS

European Search Report for European Patent Application No. 12757932.4, dated May 21, 2014.

(Continued)

*Primary Examiner* — Lauren Crane
(74) *Attorney, Agent, or Firm* — Cameron IP

(57) ABSTRACT

The present invention relates to a bath seat. The bath seat has a top and a pair of centrally disposed and spaced-apart drainage holes in communication with the top. The top of the seat includes a channel extending between the drainage holes. The channel has an enlarged first end, an enlarged second end and a connecting portion connecting the ends of the channel together. Fluid entering into the channel is directed to the drainage holes and thereby drains from the seat.

17 Claims, 12 Drawing Sheets

(56) References Cited

U.S. PATENT DOCUMENTS

| | | | | |
|---|---|---|---|---|
| D536,889 | S | 2/2007 | Self et al. | |
| D550,002 | S | 9/2007 | Genord et al. | |
| D557,516 | S | 12/2007 | Genord et al. | |
| D565,708 | S | 4/2008 | Genord et al. | |
| D566,409 | S | 4/2008 | Lindqvist et al. | |
| D580,188 | S | 11/2008 | Self et al. | |
| D589,269 | S | 3/2009 | Allende | |
| 2002/0108171 | A1 | 8/2002 | Franciosa | |
| 2004/0051365 | A1 | 3/2004 | Darst et al. | |
| 2004/0070238 | A1 | 4/2004 | Moser et al. | |
| 2010/0037385 | A1 * | 2/2010 | Hoernig et al. | 4/578.1 |
| 2010/0122408 | A1 * | 5/2010 | Mafi et al. | 4/578.1 |

FOREIGN PATENT DOCUMENTS

| | | | |
|---|---|---|---|
| EP | 0626149 | | 11/1994 |
| EP | 0 860 136 | A3 | 1/1999 |
| EP | 1987752 | | 5/2008 |
| GB | 1296177 | | 11/1972 |
| GB | 2119241 | | 11/1983 |
| GB | 2410426 | | 8/2005 |
| GB | 2427133 | | 12/2006 |
| JP | 2002-487 | | 1/2002 |
| JP | 2003-70871 | | 10/2004 |
| JP | 2008-212507 | A | 9/2008 |
| WO | WO 91/11133 | | 8/1991 |

OTHER PUBLICATIONS

English Print-out Translation of Japanese Reference JP 2002-487.
English Translation of the Abstract of Japanese Patent Reference JP 2008-212507.
English Abstract of EP0860136.
International Search Report & Written Opinion for PCT/CA2012/050156, dated Jun. 1, 2012.
Partial English Translation of JP 2003-70871.

* cited by examiner

BATH CHAIR

FIELD OF THE INVENTION

The present invention relates to a chair. In particular, the invention relates to a bath chair.

DESCRIPTION OF THE RELATED ART

Japanese Patent Ref. No. 2008-21250 discloses a bath chair with a pair of spaced-apart drainage holes within a flat-bottomed channel. The holes appear to align with respective buttock cheeks. However such a chair may not be comfortable when one is required to sit on the chair for a relatively prolonged period of time. A flat-bottomed channel may cause fluid, such as bodily fluid, to pool within the channel and not pass through the chair's drain holes. Also, the drain holes are configured to align with respective buttock cheeks. The user's buttock cheeks may thus also inhibit passage of fluid from the channel to the drain holes by blocking the drain holes. Trapped, pooled water contacting the buttock cheeks of the user may render the chair yet more uncomfortable.

U.S. Design Pat. No. D566,409 to Lindqvist et al. and U.S. Design Pat. No. 294,664 to Clark provide chairs with a plurality of channels, at least some of which include drainage holes. However the number and specific arrangement of the channels may render these chairs relatively uncomfortable to sit upon. The chairs also appear to have a number of flatter areas which may, despite a number of channels and holes, nonetheless promote undesired pooling of bodily fluids on the chairs.

BRIEF SUMMARY OF INVENTION

The present invention provides a bath chair disclosed herein that overcomes the above disadvantages. It is an object of the present invention to provide an improved bath chair.

There is accordingly provided a bath seat having a top and a pair of centrally disposed and spaced-apart drainage holes in communication with the top. The top of the seat includes a channel extending between the drainage holes. The channel has an enlarged first end, an enlarged second end and a connecting portion connecting the ends of the channel together. Fluid entering into the channel is directed to the drainage holes and thereby drains from the seat.

There is also provided a bath seat having a top, a front end, and a back end opposite thereof. The top of the seat extends between the front end and the back end of the seat. The top of the seat includes a centrally disposed channel. The channel has an enlarged first end and a second end opposite thereof. The second end of the channel is smaller than the first end of the channel. The channel includes a connecting portion connecting the ends of the channel together. The second end of the channel aligns with one of the front end and the back end of the seat. Fluid entering into the channel is directed to the second end of the channel, past said one of the front end and the back end of the seat and thereby drains from the seat.

There is further provided a bath chair. The bath chair has a seat with a top, a bottom opposite the top, a front end, a back end, and a pair of spaced-apart sides. The top and the bottom of the seat extend between the sides of the seat. The top and the bottom of the seat extend between the front end and the back end of the seat. The seat includes a pair of centrally disposed and spaced-apart drainage holes extending through the seat from the top to the bottom. The drainage holes are disposed midway along the seat between the sides of the seat. The drainage holes are disposed adjacent to respective ones of the front end and the back end of the seat. The top of the seat includes a channel extending between the drainage holes. The seat has a concave curvature with the sides of the seat being elevated relative to the channel. The channel has a rounded first end, a rounded second end and a connecting portion connecting the ends of the channel together. The ends of the channel are partially spherical. The ends of the channel are more recessed and wider than the connecting portion of the channel. The connecting portion is u-shaped between the front end of the seat and the back end of the seat. The connecting portion is more spherical in shape and more recessed towards the ends of the channel. The connecting portion and the ends of the channel are more recessed midway between the sides of the seat. The chair has a plurality of legs for supporting the chair. The legs connect to and extend from the bottom of the seat. The chair has a back for supporting a user's back. The back of the chair extends from and operatively connects to the back end of the seat. Fluid contacting the top of the seat is directed by the curvature of the seat to the channel. Fluid entering into the channel is directed to the drainage holes and thereby drains from the seat.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
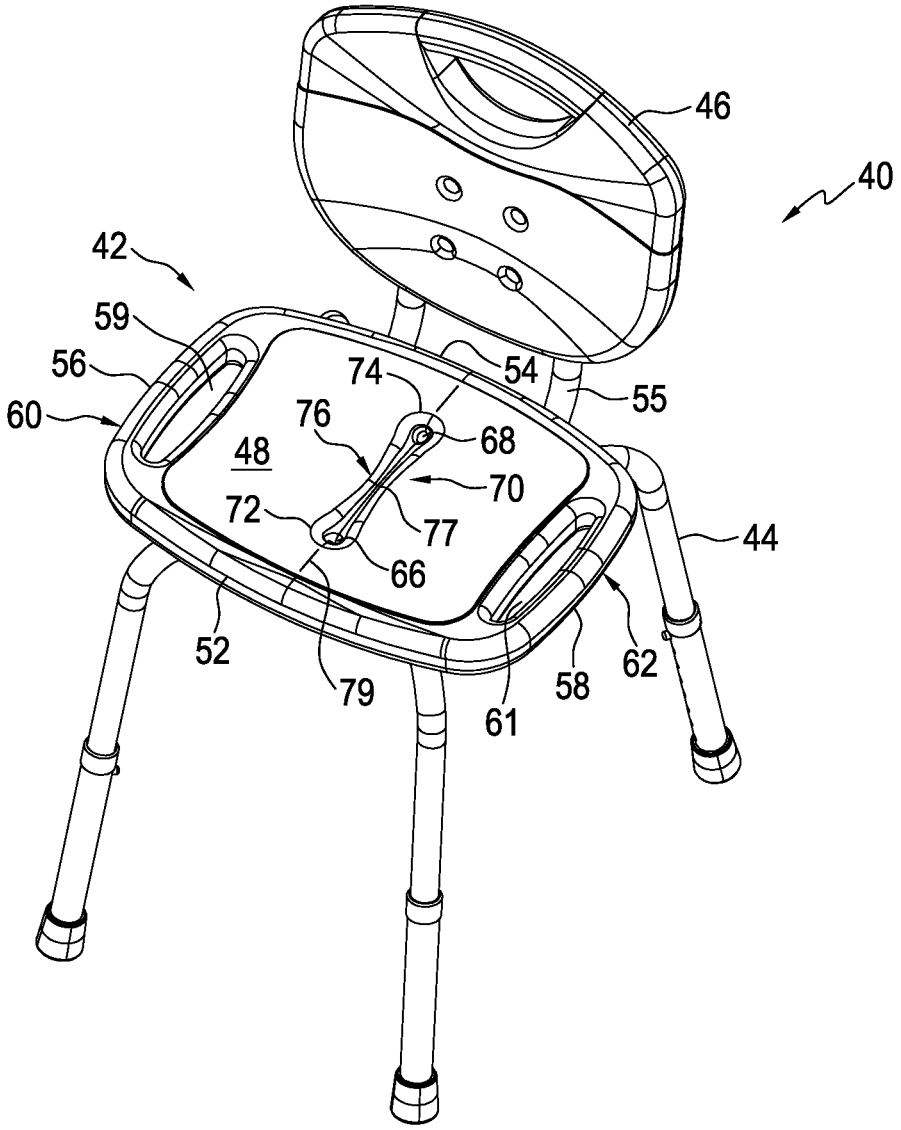
FIG. 1 is a top, front perspective view of a bath chair according to a first embodiment.
Figure 2:
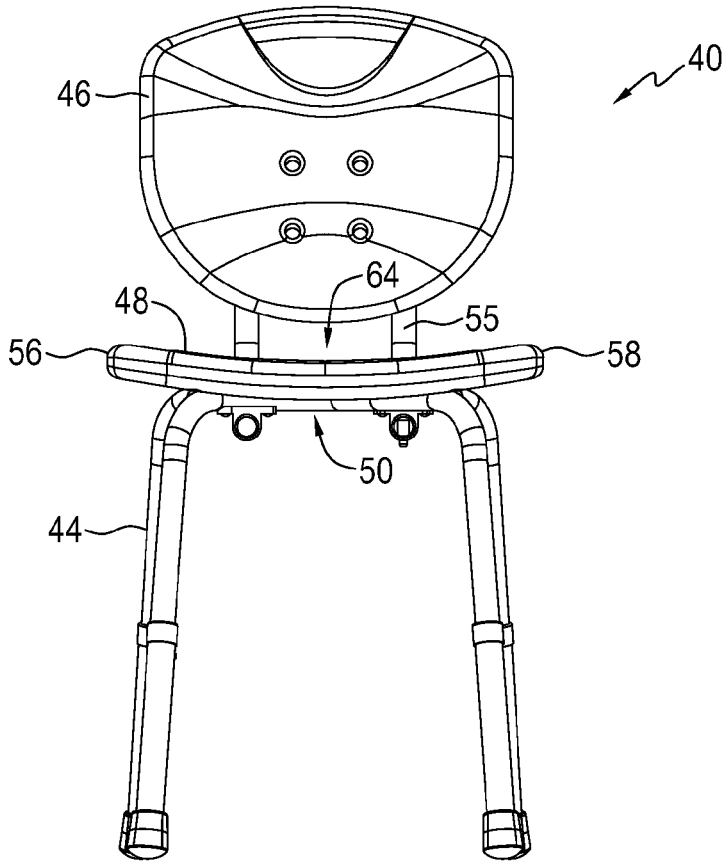
FIG. 2 is a front elevation view of the chair shown in FIG. 1.
Figure 3:
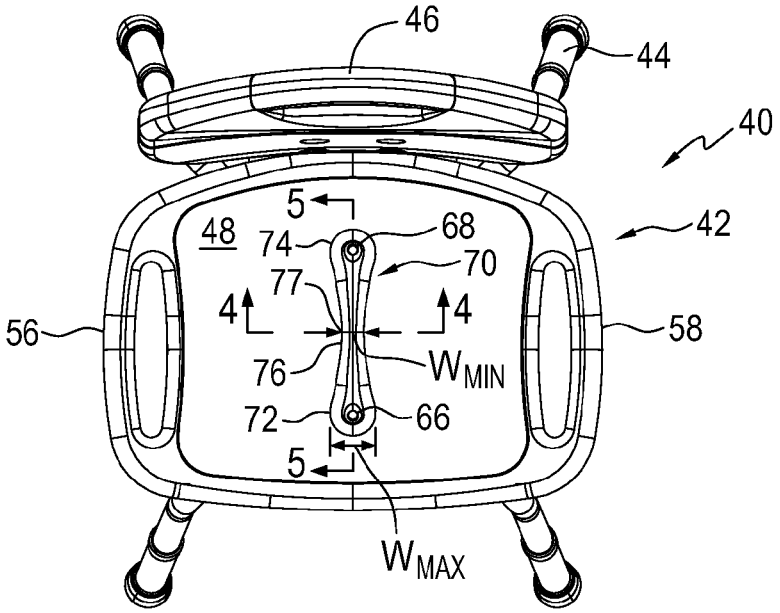
FIG. 3 is top plan view of the chair shown in FIG. 1.
Figure 4:
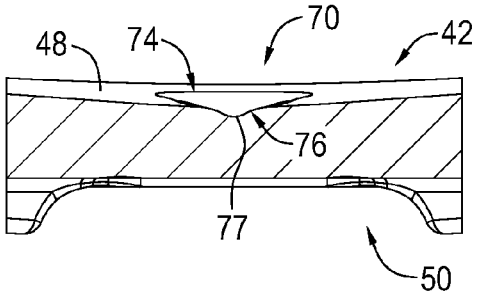
FIG. 4 is a cross-sectional view along lines 4-4 of the chair shown in FIG. 3 showing a central channel together with adjacent portions of the seat.
Figure 6:
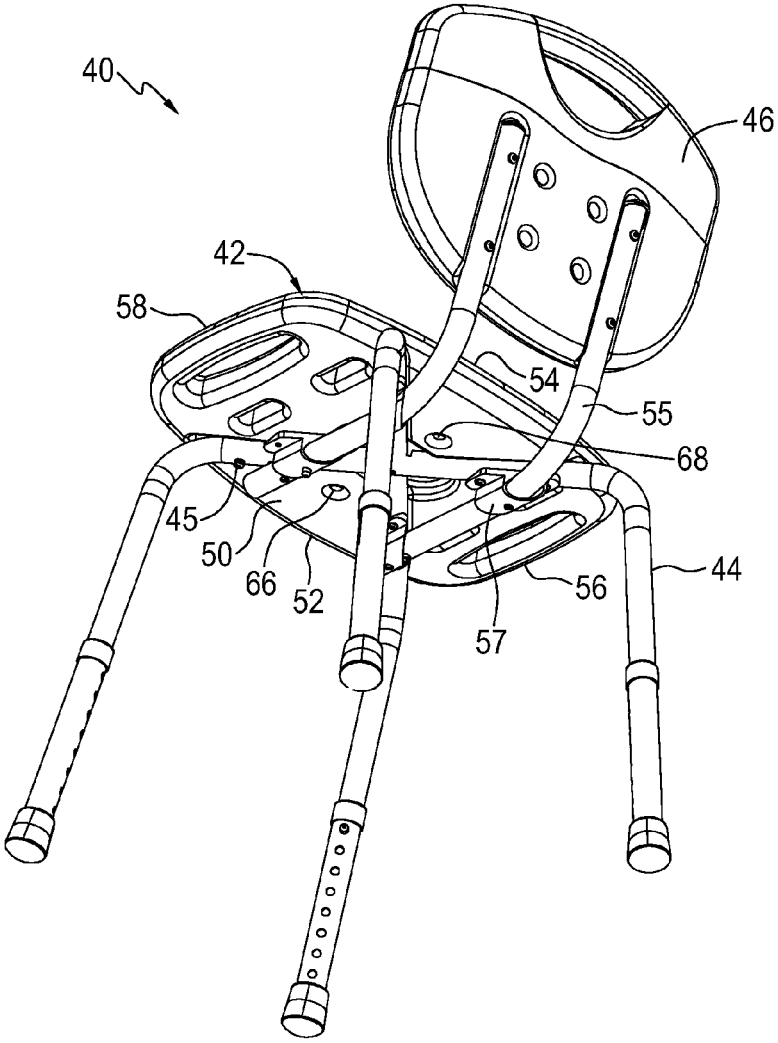
FIG. 6 is a bottom, rear perspective view of the chair shown in FIG. 1.
Figure 7:
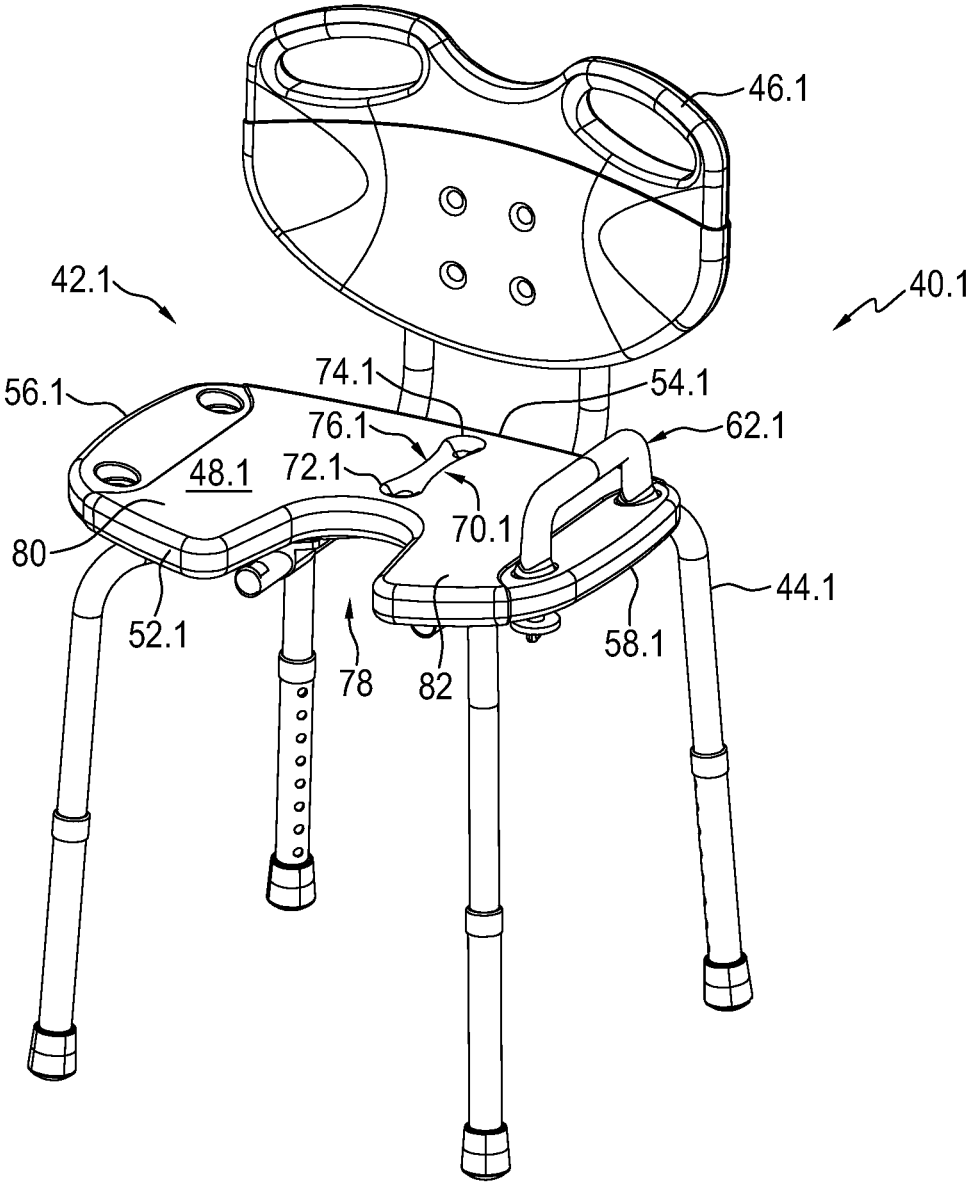
FIG. 7 is a top, front perspective view of a bath chair according another embodiment.
Figure 8:
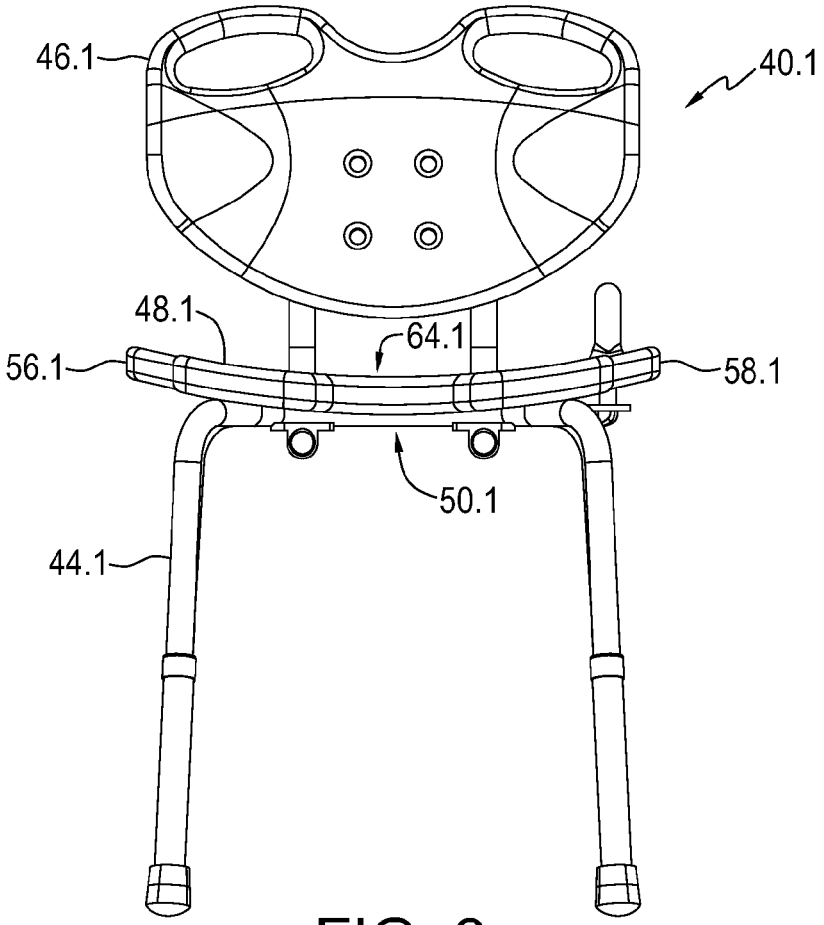
FIG. 8 is a front elevation view of the chair shown in FIG. 7.

Referring to the drawings and first to FIG. 1, there is shown a chair, in this example a bath chair 40. The bath chair includes a bath seat 42 for sitting upon when bathing. The chair includes a plurality of chair legs 44, four in this example as seen in FIG. 3, which extend downward from the seat 42 from the perspective of FIG. 1. The chair includes a back 46 that extends upwards from the seat 42 from the perspective of FIG. 1. The bath seat 42 includes a generally rectangular top 48 and a bottom 50 opposite thereof, as shown in FIGS. 2 and 4. Top 48 is preferably in the form of a cushion and/or is well-padded so as to enable a user to sit on the seat 42 for an extended period of time in a manner that inhibits discomfort. The legs 44 extend from the bottom. In this example, as shown in FIG. 6, the legs 44 are in the form of a pair of u-shaped rods that connect to bottom 50 of the seat in a cross-shaped manner via screws 45.

Referring back to FIG. 1, seat 42 has a front end 52 and a back end 54 opposite thereof. Back 46 operatively connects to and extends from the back end 54 of the seat. In this example back 46 connects via a pair of L-shaped rods 55, which extend past back end 54, to bottom 50 of the seat. As shown in FIG. 6, rods 55 connect via clamps 57 to legs 44 in this example.

As seen in FIG. 1, the seat 42 has a first side 56, a second side 58 spaced-apart from the first side, and a pair of apertures 59 and 61 extending from the top to the bottom of the seat, the apertures being adjacent to respective sides 56 and 58. Top 48 and bottom 50 extend between ends 52 and 54 and also extend between sides 56 and 58. Back 46 is disposed between sides 56 and 58. Seat 42 includes integral side handles 60 and 62 adjacent to apertures 59 and 61, as seen in FIG. 1, the handles serving as hand grips and being adjacent to sides 56 and 58 in this example.

As shown in FIG. 2, the seat 42 includes a central portion 64 located on top 48 between the sides 56 and 58. The seat 42 has an upwardly concave curvature as best shown in FIG. 2 with the sides 56 and 58 of the seat being elevated relative to the central portion 64. Put another way, the central portion 64 is recessed relative to sides 56 and 58 and extends in the direction of legs 44.

Referring to FIG. 3, the seat 42 includes a pair of centrally disposed and spaced-apart drainage holes 66 and 68 located in the central portion of the seat. The drainage holes 66 and 68 extend through the seat 42 as shown in FIGS. 1 and 6, thus enabling water from top 48 of the seat to exit from bottom 50 and away from the seat thereby.

The top 48 of the seat 42 includes a channel 70 extending between the drainage holes 66 and 68. The channel 70 has a contour that is curved. In particular, the channel 70 has an enlarged first end 72 and an enlarged second end 74 opposite thereof. Ends 72 and 74 in this example are rounded and partially spherical.

Figure 5:
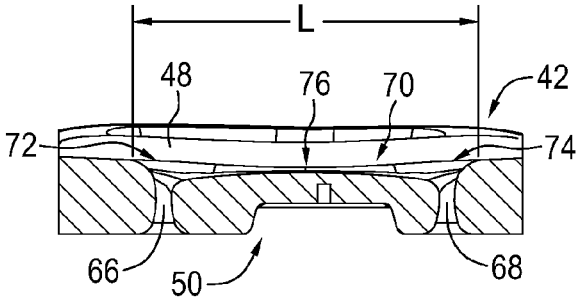
FIG. 5 is a cross-sectional view along lines 5-5 of the chair shown in FIG. 3 showing the central channel together with adjacent portions of the seat.

The channel includes a connecting portion 76 connecting the ends 72 and 74 of the channel together. Connecting portion 76 is generally u-shaped and less recessed at its midway point 77 relative to the top of the seat, as shown in FIGS. 1, 4 and 5, located between ends 72 and 74. Referring to FIGS. 1, 4 and 5, the connecting portion gradually becomes less and less u-shaped and more and more spherical in shape towards ends 72 and 74 of the channel. Ends 72 and 74 are more recessed from the top of the seat relative to connecting portion 76 as seen in FIG. 5, the channel thus slanting towards the drainage holes 66 and 68 as seen in FIG. 5 and directing water to the drainage holes. Ends 72 and 74 are wider relative to connecting portion 76, as seen for end 74 in FIG. 4. Connecting portion 76 is more and more recessed towards ends 72 and 74, and thus holes 66 and 68, of the channel relative to the top of the seat as seen in FIG. 5. As seen in FIGS. 1 and 4, connecting portion 76 and ends 72 and 76 are more recessed towards the midway line 79 between sides 56 and 58 of the seat. Channel 70 may be described as having a pair of spaced-apart lobes (rounded ends 72 and 74) at each of its ends and a narrow central portion (connecting portion 76) connecting the lobes together.

Thus, channel 70 is configured such that fluid entering into the channel 70, either via one of ends 72 and 74 or anywhere along connecting portion 76, is directed by the channel towards the drainage holes 66 and 68, causing the water to drain from the seat thereby.

As shown in FIG. 5, channel 70 has a length L extending between ends 72 and 74 that in this example is equal to 18.77 centimeters. Referring to FIG. 3, the channel has a maximum width $W_{MAX}$ adjacent to its ends 72 and 74 extending in the direction of sides 56 and 58. Width $W_{MAX}$ in this example is equal to 4.14 centimeters. The channel has a minimum width $W_{MIN}$ at its connecting portion 76 which in this example is equal to 1.94 centimeters. According to various preferred embodiments, L may equal 20 centimeters or less, $W_{MAX}$ may equal 5 centimeters or less, and $W_{MIN}$ may equal to 2.2 centimeters or less. The ratio of maximum width to minimum width of the channel may be between 1.8 and 2.2. These distances and ratios are provided by way of example and are not strictly required.

Referring to FIGS. 1 and 2, fluid originating from a user who is bathing while sitting on the chair, and/or bodily fluids released from the user who is sitting on the chair, that contact the top 48 of the seat are directed to the drain holes 66 and 68 and thus do not remain in contact with the user. Fluid contacting top 48 in a region outside the channel 70 is directed via the curvature of the seat to the seat's channel 70. Fluid contacting channel 70, entering via one of ends 72 and 74 or anywhere along connecting portion 76, is directed by the channel towards the drainage holes 66 and 68 and thus drains from the seat.

Channel 70 is particularly configured to facilitate removal of bodily fluids. Channel 70 is configured to align between the buttocks of the user and is also preferably configured to ensure that at least one of the ends 66 and 68 is disposed adjacent to the genital region of the user. The channel 70 is thus optimally positioned to capture and drain bodily fluid exiting from a user who may for example be suffering from incontinence. The channel 70 is also optimally positioned to capture and remove fluid arising from bath or shower water which may otherwise pool on the top of the seat in an uncomfortable and/or annoying manner. Put another way, the contoured channel 70 as herein described may promote more efficient drainage of fluid compared to existing, known bath chairs, while also acting to inhibit pooling of water which may otherwise occur with channels of different shapes. The placement of the channel between the buttocks of the user results in a chair that targets the capturing and drainage of bodily fluids in an efficient manner. This in turn enables the channel to be relatively compact, thus ensuring that the chair, with its padded top 48, remains comfortable to sit upon.

Figure 9:
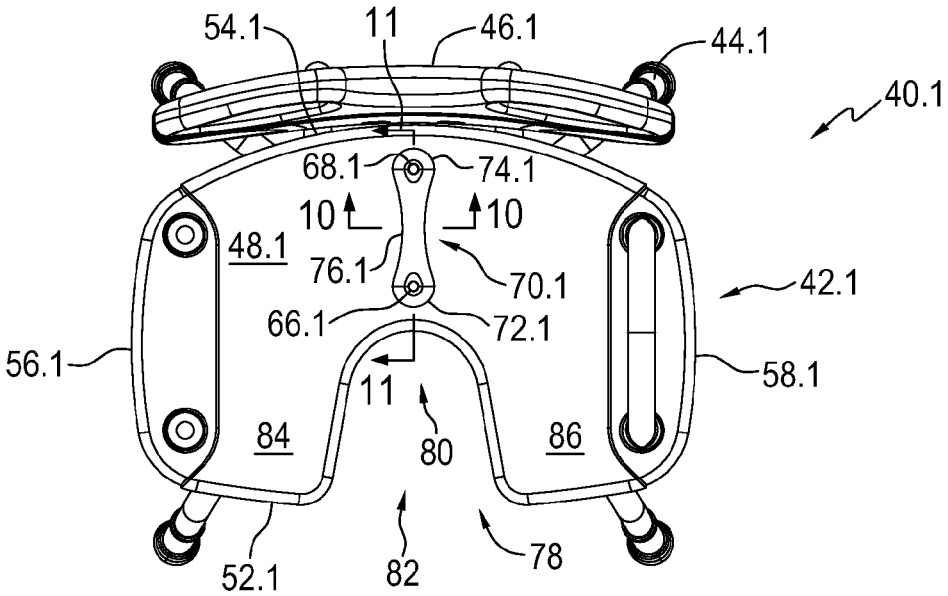
FIG. 9 is a top plan view of the chair shown in FIG. 7.
Figure 10:
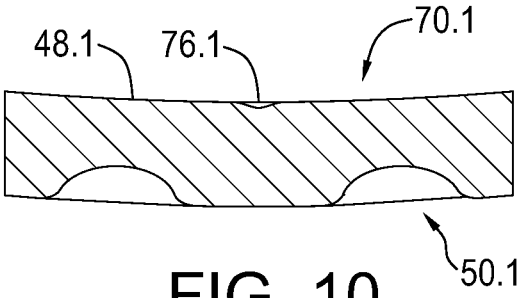
FIG. 10 is a cross-sectional view along lines 10-10 of the chair shown in FIG. 9 showing a central channel together with adjacent portions of the seat.
Figure 11:
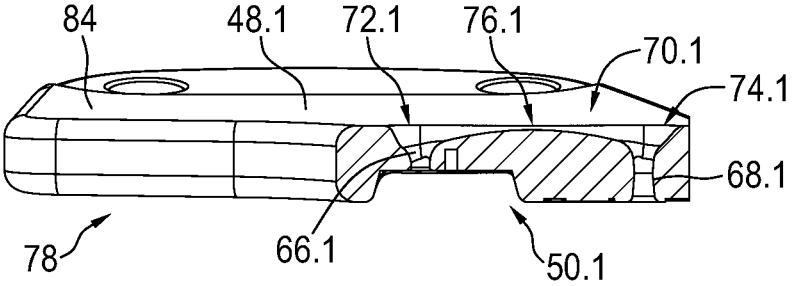
FIG. 11 is a cross-sectional view along lines 11-11 of the chair shown in FIG. 9 showing the central channel together with adjacent portions of the seat.
Figure 12:
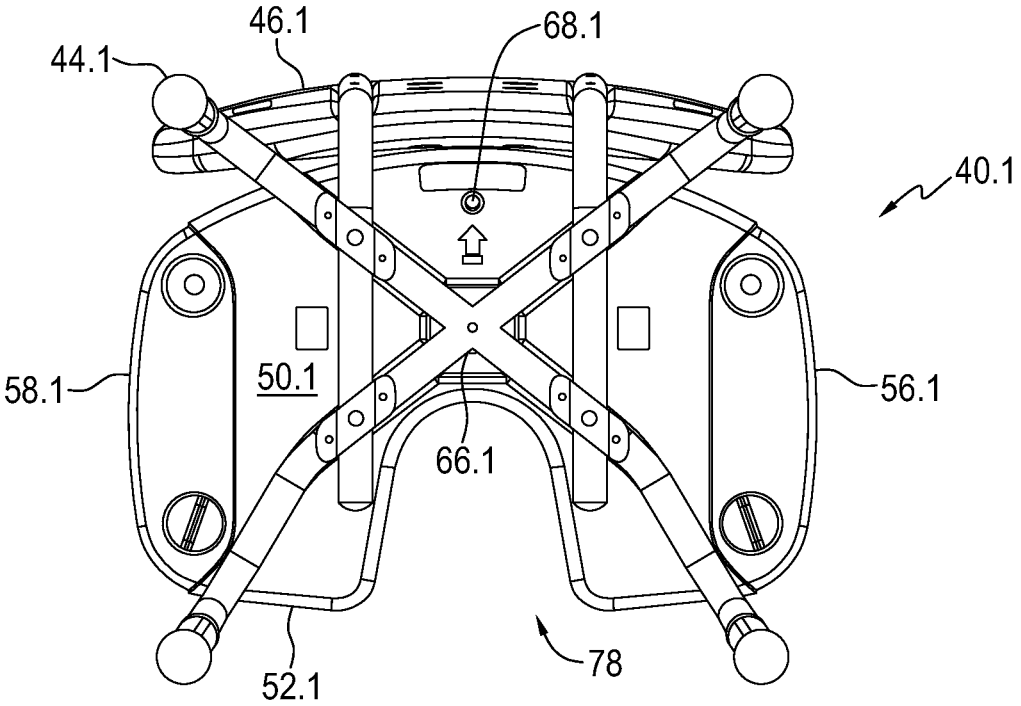
FIG. 12 is a bottom plan view of the chair shown in FIG. 7.
Figure 13:
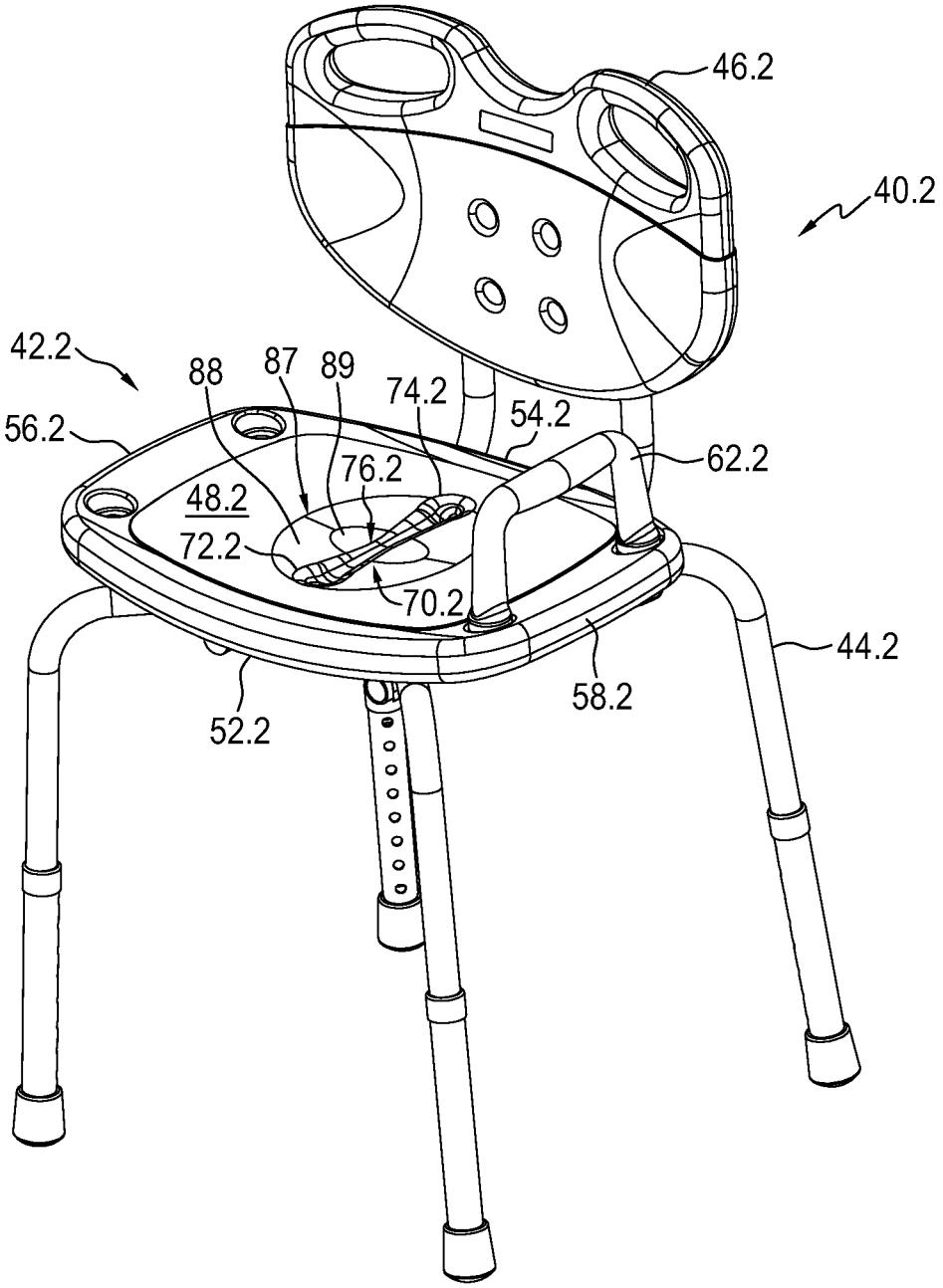
FIG. 13 is a top, front perspective view of a bath chair according to a further embodiment.

FIGS. 7 to 12 show a bath chair 40.1 and in particular a bath seat 42.1 according to another embodiment Like parts have like numbers and function as the embodiment shown in FIGS. 1 to 6 with the addition of "0.1". Bath seat 42.1 is substantially the same as seat 42 shown in FIGS. 1 to 6 with the following exceptions. Seat 42.1 includes a centrally located recess 78 defined by a u-shaped portion of the seat. The recess 78 is disposed adjacent to and extends inwards from the front end 52.1 of the seat in this example. As best shown in FIG. 9, recess 78 includes a semi-circular region 80 and an elongate region 82 adjacent thereto, which is also adjacent to front end 52.1 of the seat. The recess 78 is aligned with the channel 70.1. Channel 70.1 is interposed between recess 78 and back end 54.1 of the seat in this example.

Seat 42.1 also includes leg support portions 84 and 86 which are configured for supporting the user's thighs. Recess 78 is disposed between leg support portions 84 and 86. As previously mentioned, recess 78 is shaped such that seat 42.1 has a generally u-shape as seen from above in FIG. 9.

Recess 78 is particularly adapted for accommodating male users. Recess 78 so configured thus acts to further facilitate the drainage of fluid from the user and may thus also act to inhibit discomfort that may otherwise be felt by a man if the seat did not have such a recess. Here too channel 70.1 is centrally disposed as shown in FIG. 9 so as to align between the buttocks of the user.

Figure 16:
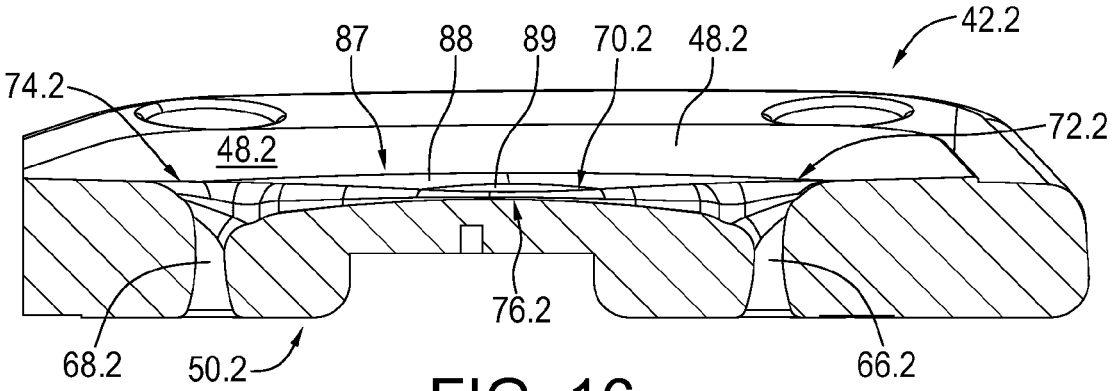
FIG. 16 is a cross-sectional view along lines 16-16 of the chair shown in FIG. 14 showing the channel and recessed portion together with adjacent portions of the seat.

FIGS. 13 to 16 show a bath chair 40.2 and in particular a bath seat 42.2 according to a further embodiment. Like parts have like numbers and function as the embodiment shown in FIGS. 1 to 6 with the addition of "0.2". Bath seat 42.2 is substantially the same as seat 42 shown in FIGS. 1 to 6 with one exception being that top 48.2 of the seat 42.2 includes an oval-shaped recessed portion 87. The oval-shaped recessed portion 87 is concave and partially spherical. Channel 70.2 is more recessed than oval-shaped recess portion 87 as seen in FIG. 16.

Figure 14:
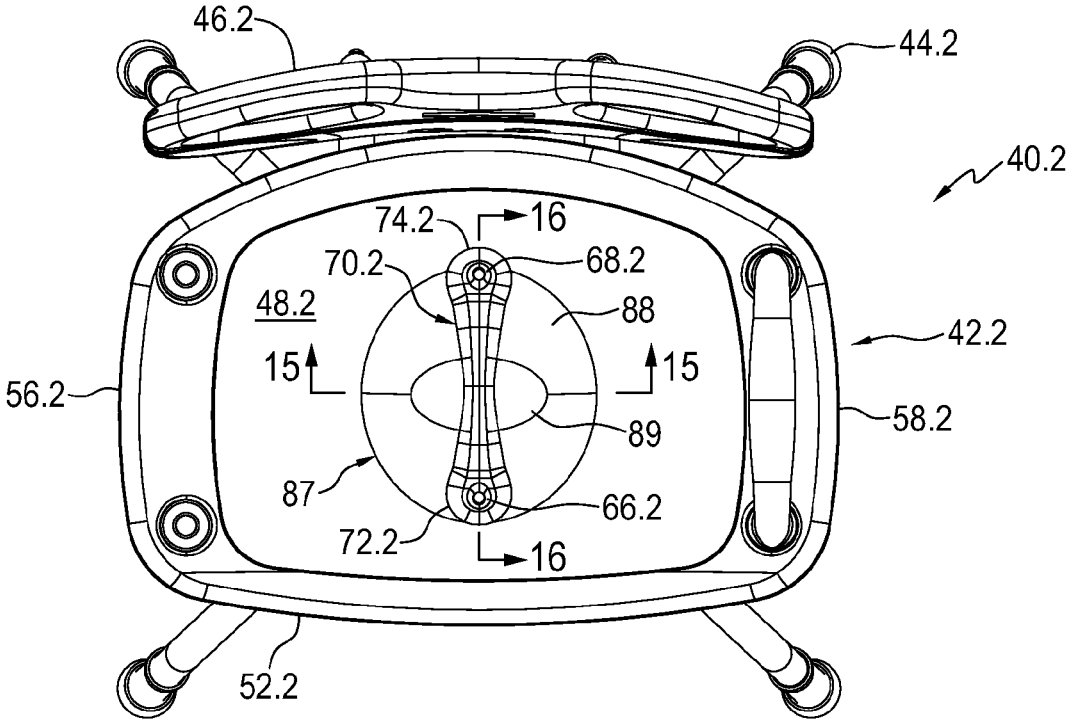
FIG. 14 is a top plan view of the chair shown in FIG. 13, the chair having a channel and an oval-shaped recessed portion.
Figure 15:
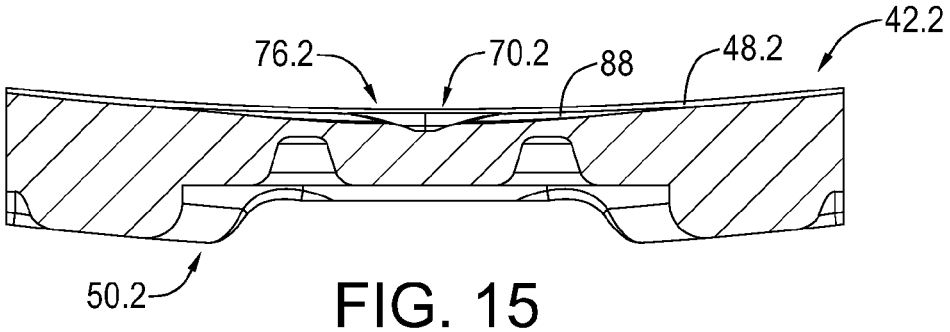
FIG. 15 is a cross-sectional view along lines 15-15 of the chair shown in FIG. 14 showing the channel and recessed portion together with adjacent portions of the seat.

Recessed portion 87 includes an outer region 88. As seen in FIG. 14, outer region 88 of recessed portion 87 extends around the drainage holes 66.2 and 68.2. Outer region 88 is also disposed to at least partially extend around the channel 70.2 and is disposed to at least partially extend around at least one of the ends of the channel, in this example extending around end 72.2 of the channel.

Recessed portion 87 includes an inner region 89 surrounded by outer region 88. Inner region 89 of the recessed portion 87 is generally more recessed than the outer region 88 as seen in FIG. 16. As shown in FIG. 14, inner region 89 is elliptical in shape with its major axis extending towards sides 56.2 and 58.2 of the seat. Inner region 89 of the recessed portion 87 is configured to direct fluid entering therein towards connecting portion 76.2. The recessed portion 87 is thus configured to direct fluid contacting recessed portion 87 to channel 70.2 and further facilitates removal of fluid from the seat 42.2.

Figure 17:
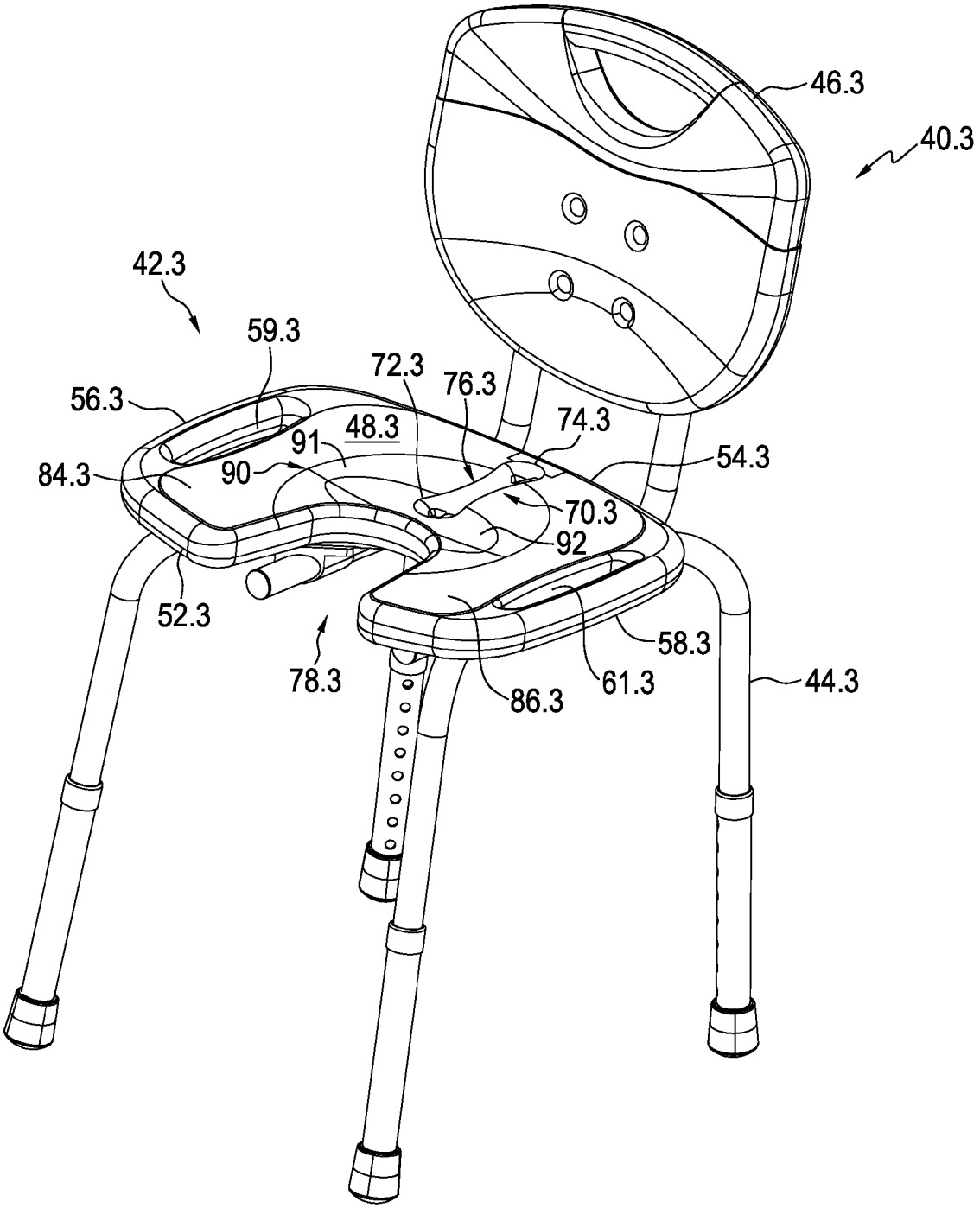
FIG. 17 is a top, front perspective view of a bath chair according to yet another embodiment.
Figure 18:
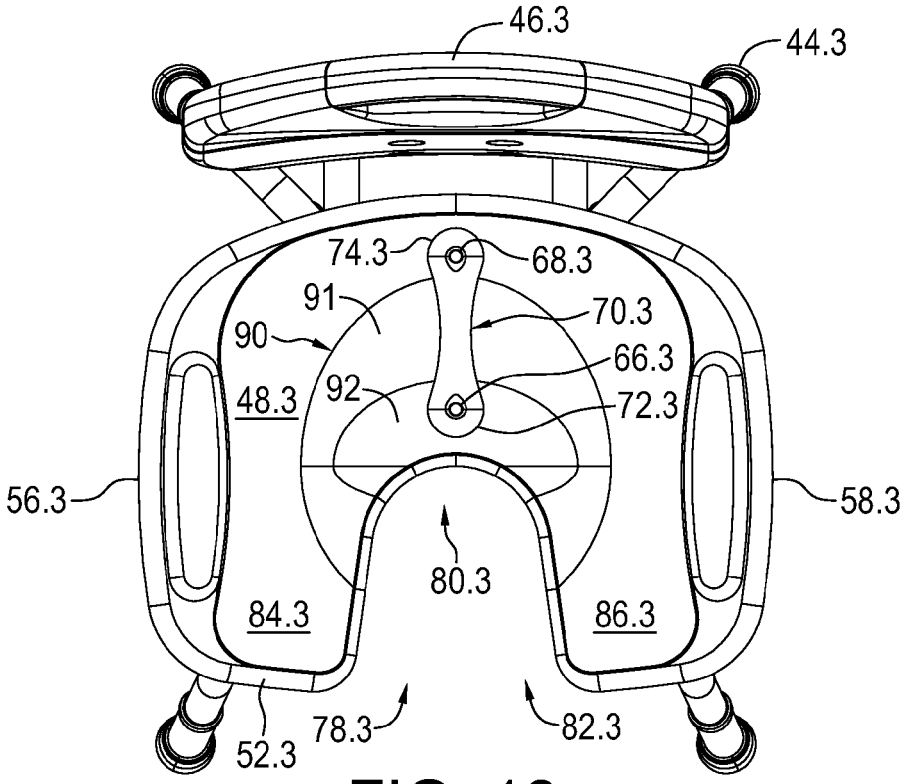
FIG. 18 is a top plan view of the chair shown in FIG. 17, the chair having a channel and an oval-shaped recessed portion.
Figure 19:
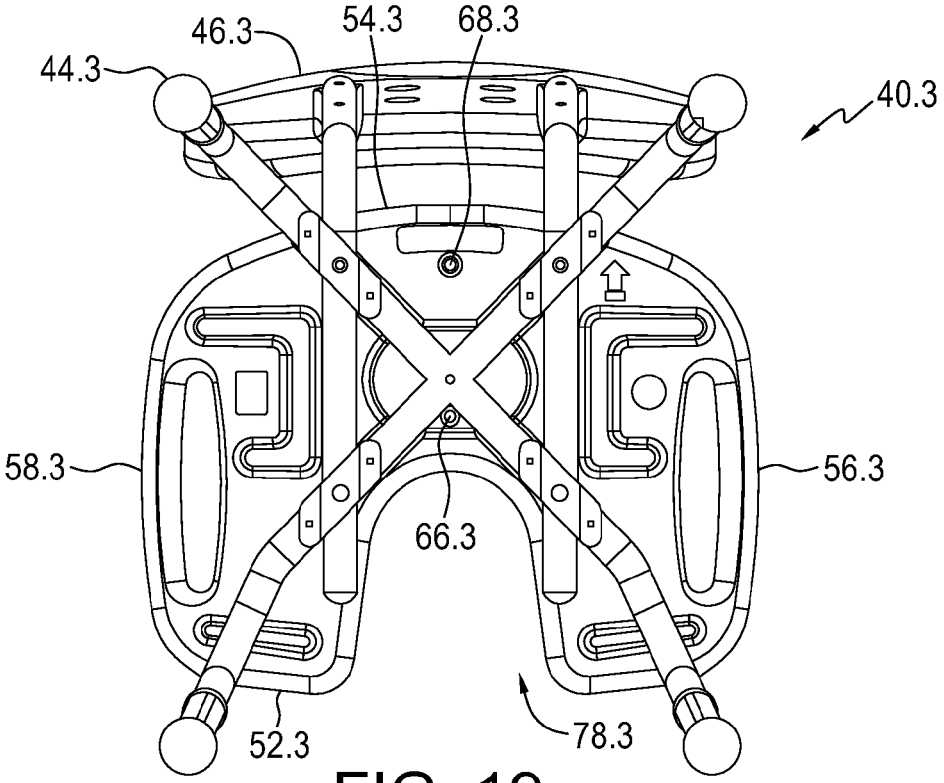
FIG. 19 is a bottom plan view of the chair shown in FIG. 17.

FIGS. 17 to 19 show a bath chair 40.3 and in particular a bath seat 42.3 according to yet another embodiment. Like parts have like numbers and function as the embodiment shown in FIGS. 7 to 12 with the addition of ".3" to replace ".1" and the addition of ".3" to corresponding parts not having ".1" in FIGS. 7 to 12. A pair of apertures 59.3 and 61.3 extend from the top to the bottom of the seat, the apertures being substantially similar to apertures 59 and 61 set out in FIG. 1. The top 48.3 of the seat 42.3 includes a centrally disposed oval-shaped recessed portion 90 substantially similar to recessed portion 87 shown for seat 42.2 in the embodiment shown in FIGS. 13 to 16. Recessed portion 90 is concave, partially spherical and aligns with channel 70.3 and recess 78.3. Recessed portion 90 is disposed to at least partially extend around both channel 70.3 and recess 78.3.

Recessed portion 90 includes an outer region 91 and an inner region 92 surrounded by outer region 91. Inner region 92 is more recessed than outer region 91. Inner region 92 is oval in shape with its major axis extending towards sides 56.3 and 58.3 of the seat. As shown in FIG. 18, inner region 92 of the recessed portion 90 is shaped to extend around end 72.3 and drainage hole 66.3 and is also shaped to partially extend around semi-circular region 80.3 of recess 78.3.

Recessed portion 90 is thus configured to direct fluid contacting the seat to the channel 70.3 and/or to the recess 78.3. Recessed portion 90 provides a synergy in further facilitating drainage of fluid while at the same time being configured to render the seat 42.3 more comfortable to the user.

Figure 20:
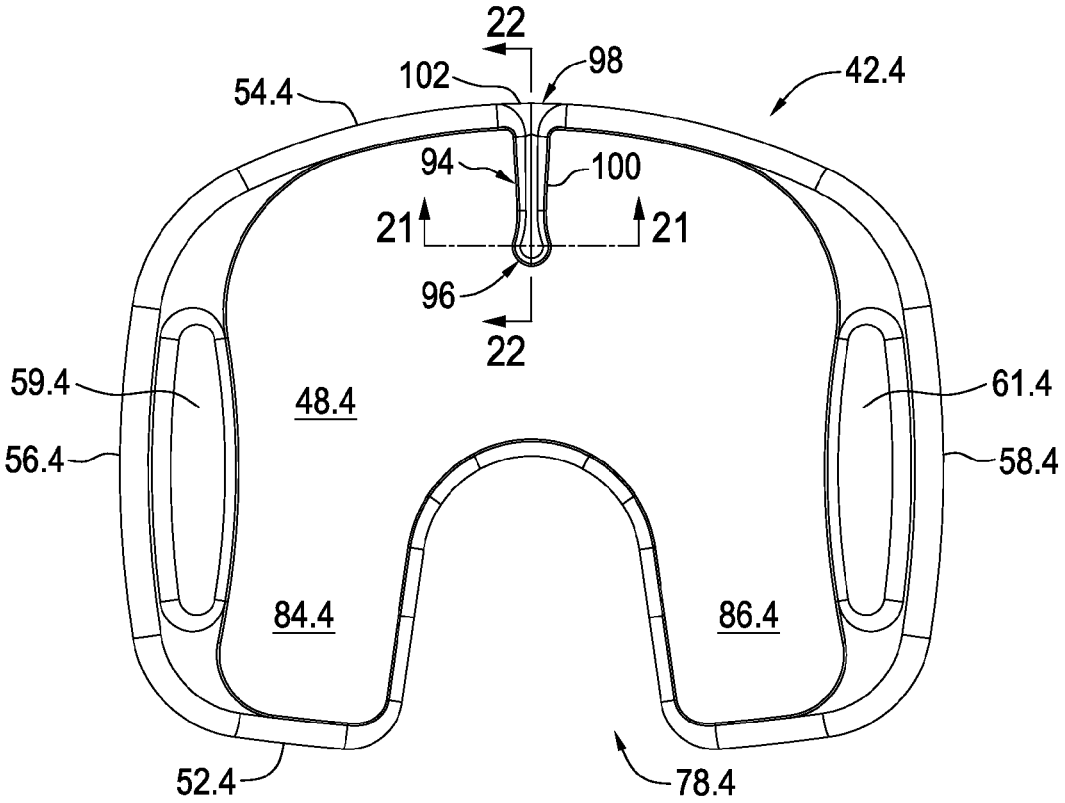
FIG. 20 is a top plan view of a seat for a chair according to yet a further embodiment, the seat having a channel located at the back end of the seat.
Figure 21:
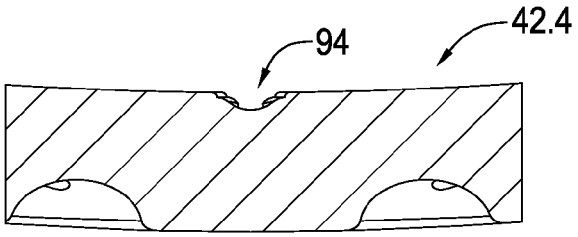
FIG. 21 is a cross-sectional view along lines 21-21 of the seat shown in FIG. 20 showing the channel together with adjacent portions of the seat.
Figure 22:
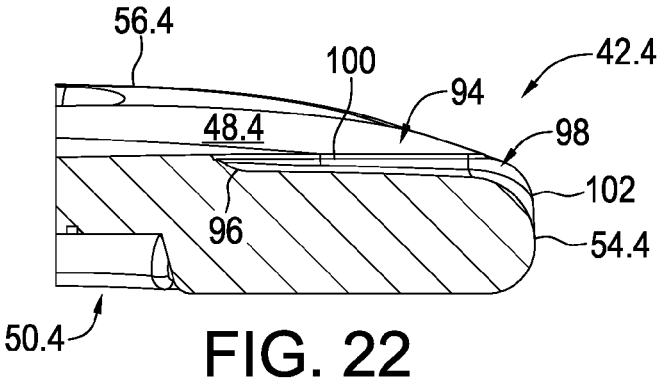
FIG. 22 is a cross-sectional view along lines 22-22 of the seat shown in FIG. 20 showing the channel together with adjacent portions of the seat.

FIGS. 20 to 22 show a bath seat 42.4, which may be used with a bath chair such as that shown in FIGS. 1 to 6, according to yet a further embodiment. Like parts have like numbers and function as the embodiment shown in FIGS. 7 to 12 with the addition of ".4" replacing ".1" and the addition of ".4" for corresponding parts not having ".1" in FIGS. 7 to 12. A pair of apertures 59.4 and 61.4 extend from the top to the bottom of the seat, the apertures being substantially similar to apertures 59 and 61 set out in FIG. 1. Seat 42.4 is substantially the same as seat 42.1 shown in FIGS. 7 to 12 with one exception being that instead of channel 70.1, the top 48.4 of the seat 42.4 has a channel 94.

Channel 94 has a contour that is curved, with an enlarged first end 96 and a second end 98 opposite thereof. The first end 96 in this example is rounded, partially spherical and semi-circular in part. The second end 98 aligns with and is adjacent to back end 54.4 of the seat in this example. The second end 98 is smaller in width than the first end and is u-shaped. The channel 94 includes a connecting portion 100 connecting the ends 96 and 98 of the channel together. The connecting portion 100 is u-shaped and is less and less u-shaped and more and more spherical in shape towards end 96.

As shown in FIG. 22, the channel 94 includes a curved recess 102 at its second end 98 that extends towards bottom 50.4 of the seat and partially through back end 54.4 of the seat. As shown in FIG. 20, recess 102 also expands more and more outwards towards sides 56.4 and 58.4 of the seat as recess 102 extends towards back end 54.4 of the seat. Recess 102 is thus configured to direct water from the channel 94 in a downwards and outwards direction away from the seat.

Seat 42.4 with its channel 94 is thus adapted for capturing and draining bodily fluid in another manner. Fluid entering the channel 94 is directed to the second end 98 of the channel 94, past back end 54.4 and drained via gravity away from the seat 42.4. The centrally located, circular, spherical aspect of end 96 of the channel 94 optimizes the channel's ability to capture bodily fluid in an efficient, compact and targeted manner, while at the same time ensuring that the seat remains relatively comfortable for the user to sit upon. Recess 78.4 is aligned with channel 94 and is configured to further facilitate drainage of fluid away from the seat thereby.

Figure 23:
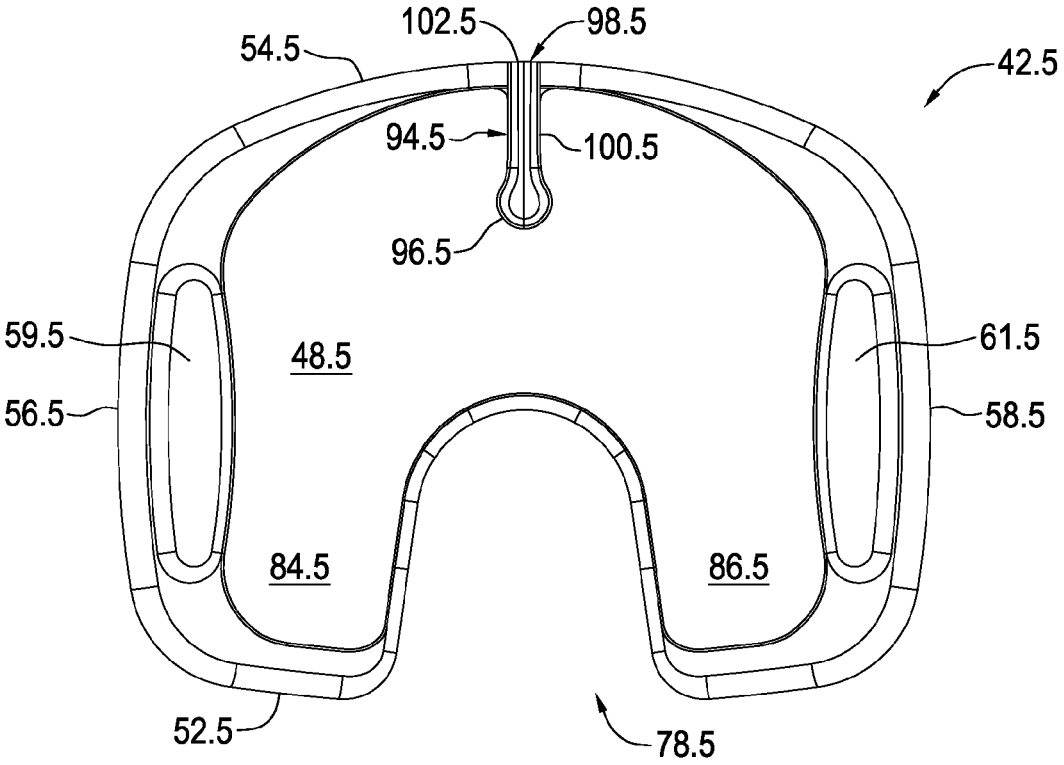
FIG. 23 is a top plan view of a seat for a chair according to an even further embodiment, the seat having a channel located at the back end of the seat.

FIG. 23 shows a bath seat 42.5, which may be used with a bath chair such as that shown in FIGS. 1 to 6, according to yet another embodiment. Like parts have like numbers and function as the embodiment shown in FIGS. 20 to 22 with the addition of ".5" replacing "A" and the addition of ".5" for corresponding parts not having ".4" in FIGS. 20 to 22. A pair of apertures 59.5 and 61.5 extend from the top to the bottom of the seat, the apertures being substantially similar to apertures 59 and 61 set out in FIG. 1. Seat 42.5 is substantially the same as seat 42.4 shown in FIGS. 20 to 22 with the exception that curved recess 102.5 extends from the connection portion 100.5 in a straight and continuous manner relative to sides 56.5 and 58.5 of the seat.

It will be appreciated that many variations are possible within the scope of the invention described herein. For example, the recess generally indicated by numeral 78 may extend inwards from the back end of the chair. The terms circular and spherical, as described herein for ends, channels and the like, are not strictly geometrical terms but rather describe general shape and can vary. Although the chair described herein is referred to as a bath chair, the chair may also be used for showers, sponge bathing and other forms of washing.

It will be understood by someone skilled in the art that many of the details provided above are by way of example only and are not intended to limit the scope of the invention which is to be determined with reference to the following claims.

What is claimed is:

1. A bath seat comprising:

a top and a pair of centrally disposed and spaced-apart drainage holes in communication with the top, the top including a channel extending between the drainage holes and directing water to the drainage holes, the channel having an enlarged first end, an enlarged second end and a connecting portion connecting the ends of the channel together, the ends of the channel being wider than the connecting portion of the channel, and the ends of the channel being more recessed relative to the top of the seat than the connecting portion of the channel, whereby fluid entering into the channel is directed to the drainage holes and thereby drains from the seat; the connection portion of the channel being recessed relative to the top of the seat and being less recessed relative to the rest of the connecting portion at a midpoint between the drainage holes.

2. The seat as claimed in claim 1 wherein the channel is concave and the ends of the channel are rounded.

3. The seat as claimed in claim 1 wherein the first end and the second end of the channel are partially spherical.

4. The seat as claimed in claim 1 wherein the channel is concave, wherein the seat has a first side and a second side, the top extending from the first side to the second side, the channel being centrally disposed between the first side and the second side of the seat, and wherein the seat has a curvature with the first side and the second side of the seat being elevated relative to the channel, fluid contacting the top of the seat thus being directed by the curvature of the seat to the channel thereby.

5. The seat as claimed in claim 1 wherein the channel has a contour that is concave and wherein the channel is configured to facilitate drainage of bodily fluids.

6. The seat as claimed in claim 1 wherein the top of the seat includes an oval-shaped recessed portion, the channel being more recessed than the oval-shaped recessed portion, the oval-shaped recessed portion being disposed to at least partially extend around the channel.

7. The seat as claimed in claim 6 wherein the oval-shaped recessed portion is partially spherical and is configured to direct fluid contacting the seat to the channel.

8. The seat as claimed in claim 5 wherein the seat includes a front end and a back end opposite thereof, the top of the seat extending between the front end and the back end, the first end of the channel being disposed adjacent to the front end of the seat, the second end of the channel being disposed adjacent to the back end of the seat, and the channel extending between the front end and the back end of the seat.

9. The seat as claimed in claim 1 wherein the seat includes a front end and a back end opposite thereof, the top of the seat extending between the front end and the back end, and wherein the seat further includes a recess defined by a u-shaped portion of the seat, the recess being disposed adjacent to and extending inwards from a first one of the front end and the back end of the seat, the recess being aligned with the channel and being configured to further facilitate drainage of bodily fluids.

10. The seat as claimed in claim 9, wherein the recess and the u-shaped portion of the seat are configured to accommodate male users and wherein the channel is interposed between the recess and a second one of the front end and the back end of the seat.

11. The seat as claimed in claim 9 wherein the top of the seat includes an oval-shaped recessed portion, the channel being more recessed than the oval-shaped recessed portion, the oval-shaped recessed portion being disposed to at least partially extend around both the channel and the recess and being configured to direct fluid contacting the seat to at least one of the channel and the recess.

12. The bath seat as claimed in claim 1, wherein the channel has a length between its ends of no more than 20 centimeters and has a maximum width adjacent to its ends of no more than 5 centimeters.

13. The bath seat as claimed in claim 12 wherein the channel has a minimum width at its connecting portion of no more than 2.2 centimeters.

14. The bath seat as claimed in claim 1 wherein the channel has maximum widths adjacent to its ends and a minimum width at the connecting portion, with the ratio of maximum width to minimum width being between 1.8 and 2.2.

15. The seat as claimed in claim 1, the seat having a first side, a second side spaced-apart from the first side, a bottom spaced-apart from the top, the top and the bottom extending between the first side and the second side, and a pair of apertures adjacent to respective ones of the sides, the apertures extending from the top to the bottom of the seat, the apertures forming integral side handles.

16. The seat as claimed in claim 1, wherein the connecting portion of the channel is more and more recessed towards respective ones of the drainage holes.

17. The seat as claimed in claim 1, wherein the connection portion of the channel slants towards respective ones of the drainage holes.

* * * * *